US006478672B1

(12) United States Patent
Ewald et al.

(10) Patent No.: US 6,478,672 B1
(45) Date of Patent: Nov. 12, 2002

(54) METHOD AND DEVICE FOR EXTRACTING FUMES AND HEAT AND FOR PROVIDING OPERATIONAL FOR TRAFFIC STRUCTURES AND ENCLOSED TRAFFIC SPACES

(75) Inventors: Hartmut Ewald, Kroepelin; Detlev Liebau, Jesteburg, both of (DE)

(73) Assignee: Deus Energie-und Umweltsysteme GmbH, Jesteburg (DE)

( * ) Notice: Subject to any disclaimer, the term of this patent is extended or adjusted under 35 U.S.C. 154(b) by 0 days.

(21) Appl. No.: 09/743,227

(22) PCT Filed: Jun. 3, 1999

(86) PCT No.: PCT/EP99/03856

§ 371 (c)(1),
(2), (4) Date: Jun. 26, 2001

(87) PCT Pub. No.: WO99/64723

PCT Pub. Date: Dec. 16, 1999

(30) Foreign Application Priority Data

Jun. 6, 1998 (DE) ..... 198 25 420

(51) Int. Cl.[7] ..... E21F 1/00
(52) U.S. Cl. ..... 454/167; 454/342
(58) Field of Search ..... 454/167, 166, 454/342, 338

(56) References Cited

U.S. PATENT DOCUMENTS 851,411 A * 4/1907 Ferrell ..... 454/167
1,731,289 A * 10/1929 Blair ..... 34/223
2,427,075 A * 9/1947 Singstad ..... 454/167
3,791,752 A * 2/1974 Gardner ..... 404/2
3,823,654 A * 7/1974 Swaty ..... 454/167
5,722,885 A * 3/1998 Matthews ..... 454/167

FOREIGN PATENT DOCUMENTS

| | | |
|---|---|---|
| EP | 0428108 A2 | 5/1991 |
| JP | 6-233832 | 8/1994 |
| JP | 8-299483 | 11/1996 |
| WO | WO94/10031 | 5/1994 |
| WO | WO94/26356 | 11/1994 |

* cited by examiner

*Primary Examiner*—Harold Joyce
*Assistant Examiner*—Derek S. Boles
(74) *Attorney, Agent, or Firm*—Jordan and Hamburg LLP

(57) ABSTRACT

The invention relates to a method and a device for extracting fumes and heat and for providing operational ventilation for traffic structures and enclosed traffic spaces. The inventive system for drawing off fumes and heat and for providing operational ventilation for traffic structures and enclosed traffic spaces does not use any pipe ventilators for extracting the fumes and builds up a vacuum throughout a duct in order to extract the fumes. The system is characterized in that a number of reversible jet ventilators are provided inside a modular smoke extraction duct situated preferably beneath the tunnel ceiling or the ceiling of an enclosed space. The jet ventilators are evenly distributed over the length of the duct and the duct itself has evenly distributed openings. The jet ventilators are able to rapidly accelerate the air or the fumes of a fire on the road in a particular direction in the duct by virtue of an impulse effect.

9 Claims, 4 Drawing Sheets

Figure 1:
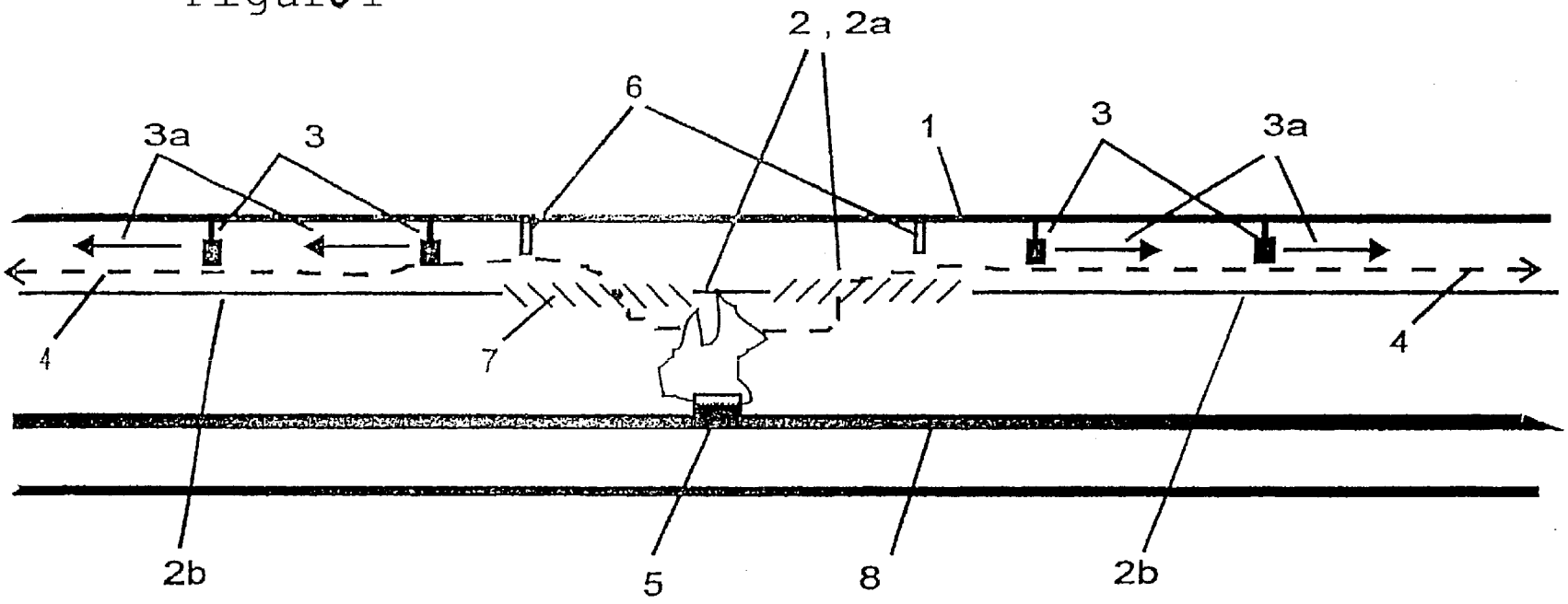

METHOD AND DEVICE FOR EXTRACTING FUMES AND HEAT AND FOR PROVIDING OPERATIONAL FOR TRAFFIC STRUCTURES AND ENCLOSED TRAFFIC SPACES

The invention relates to a method and a device for extracting fumes and heat in the event of a fire by the locally selective exhaustion of fumes, as well as the ventilation in event of "heavy traffic" or "poor air quality" by the exhaustion of pollutant-laden air or by the selective supply of fresh air for traffic structures and spaces.

In case of fires in traffic spaces, such as tunnels, it must be ensured that, for a certain period of time, the visibility does not deteriorate due to the fumes and plume gases evolved to such an extent, that the intended flight paths can no longer be recognized reliably or utilized safely and, because of high temperatures, poisonous gases and a detonation of incompletely combusted gases, people in the traffic space, the safety facilities or the structure itself are endangered.

The previously used fume-extraction facilities in traffic structures and enclosed spaces (see EP 0428 108 A2) basically have the advantage that, on the one hand, the visibility necessary for rescuing persons and objects is improved and, on the other, the temperatures are significantly lower and the amounts of fumes significantly less in the vicinity of the fire than in the absence of fume-extraction facilities.

For enclosed spaces, the fume-extraction facilities of DIN 18 232 (part 1 to part 3) can be projected in such a manner, that free visibility up to a certain height is ensured for an assumed fire load. In general, for various reasons, this procedure is not possible for traffic structures.

For traffic structures, such as tunnels, different concepts are known for meeting the fire protection requirements and adhering to visibility conditions. Essentially, there are two different methods.

In the event of a fire in a tunnel, a vigorous longitudinal ventilation, for example, over large jet ventilators, is produced in such a manner that the windward side of the fire is kept free of smoke in every case (no back-layering of the fumes). The axial flow velocities in the tunnel, required for this purpose, are known and range from 4 to 6 m/s. However, at these flow velocities, the lee side of the fire is filled completely with smoke and can no longer be used as a flight path.

The second method comprises the extraction of fumes over special fume-extraction ducts, which are disposed over the whole length of the tunnel. Either fumes are extracted uniformly over all existing openings in the fume-extraction duct (multi-point system) or, of the fire covers, which are distributed uniformly in the whole of the smoke-extraction duct, only those in the vicinity of the fire are opened. Over the latter, the fire gases can then be extracted (single-point system). The single-point extraction has generally turned out to be the more efficient method.

In all known cases of fume-extraction facilities, pipe ventilators (portal ventilators) are used to extract fumes and are generally mounted centrally to the outlet of the fume-extraction ducts, (portal or chimney) (for example, EP 0428 105 A2). These facilities can partly also be used for the operational ventilation, either by extracting pollutant-laden air (semi-transverse ventilation by outgoing air) or by supplying fresh air (semi-transverse ventilation by incoming air), in that the portal ventilators are reversed.

The essential disadvantage of all known arrangements for extracting fumes is the following. On the one hand, a reduced pressure must be built up, to begin with, by the portal ventilator (pipe ventilator), which is at the end of the extraction system, so that the fire gases can be extracted through the openings (fire covers) into the fume-extraction duct. The greatest pressure difference exists directly at the pipe ventilator and the least pressure difference exists at the opening, through which the fumes are to be extracted. In the case of longer distances, such as in tunnels, the time required to build up the necessary reduced pressure can amount to a few minutes. On the other hand, in the case of a single-point system, it must be assumed that all fire covers of the whole of the fume-extraction duct, which are not in the vicinity of the fire, are pressure-tight. In the event of leakages or if fire covers have been opened wrongly, the effectiveness of the pipe ventilator and, with that, the extraction performance are reduced. This can lead to a total failure of the system in the event of a fire. Furthermore, components and facilities, in the vicinity of the fire, including the extraction duct and the portal valves can themselves be involved as a result of the high temperatures of the fire. In the case of fires in the vicinity of the portal ventilators, the latter are no longer capable of functioning because of the high temperatures at the pipe ventilators. Moreover, two portal ventilators are generally used, resulting in twice the installed performance, in order to increase the safety (redundancy) of the system.

If some of the fumes extracted are combusted incompletely and mixed at a high temperature with fresh air in the fume-extraction duct, there may be detonations, which destroy the fume-extraction system and, in addition, endanger persons in the traffic space.

Installations or facilities, in which the conventional fume-extraction equipment is supplemented by sprinkler equipment in the vicinity of the fire, are also known (EP 0703807 A1).

It is therefore an object of the invention to construct a fume and heat extraction device as well as operational ventilation for traffic structures and enclosed spaces, which act essentially without delay when switched on, do not become ineffective due to leakages at the fume duct, offer the parts of the device themselves (fume-extraction duct and tunnel wall) reliable protection even at high fire loads and extraction of incompletely combusted gases and realize the function of operational ventilation as semi-transverse ventilation by outgoing air, as semi-transverse ventilation by incoming air and as their combination.

Pursuant to the invention, this objective is accomplished by the distinguishing features of claims 1 and 6. Advantageous developments arise out of the dependent claims. In the following, the invention is described by means of examples illustrated in FIGS. 1 and 2*a, b* and *c*.

The inventive method and the device of a fume and heat extraction installation as well as an operational ventilation for traffic structures and enclosed spaces is characterized in that, in the interior of a fume-extraction duct 2, constructed in modular fashion preferably below the tunnel ceiling 1 or the room ceiling and having large ceiling openings 2*a*, which are distributed uniformly, there is a plurality of reversible jet ventilators 3, which are distributed uniformly over the whole length and accelerate the air or fumes 4 of a fire 5 on the roadway 8 in the fume-extraction duct within a short time by their pulse action 3*a* in the respective direction (FIG. 1). The hot fumes, then flowing in in the event of a fire, are cooled immediately in the fume-extraction duct indirectly by water cooling of the walls surrounding the fume-extraction duct and/or directly by evaporative cooling 6 (jet lance and optionally "water quenching"), so that the temperature and, in some cases, also the volume of the fumes to be discharged are decreased and the action of the jet ventilators is intensified due to the change in the density of the fumes. The temperature of the fumes is adjusted by the evaporative cooling so that, even in the case of continuous operation, damage to the structure and the installation cannot develop and hot water cannot drip into the traffic space. The wall cooling of the fume-extraction duct and the evaporative cooling in the fume-extraction duct accordingly also result in the protection of the structure itself.

Due to the uniform arrangement of the jet ventilators, the whole of the fume/air "column" 4 in the fume-extraction duct is quickly accelerated at the same time in the respective direction (FIG. 1). The number and output of the jet ventilators 3 depend on the cross section of the fume-extraction duct 2 and on the projected extraction performance of the installation (amount of fumes), which can be derived from the fire load, which is to be mastered.

The extraction by the single-point system is achieved by the reversible jet ventilators in such a manner that all jet ventilators to the right of the fire go into operation towards the right and those to the left of the fire go into operations towards the left. This results in a locally limited extraction of the fumes in the region of the fire (see also FIG. 1). In the region of the fire itself the jet ventilators are not switched on; the temperature of the fumes is lowered here, above all, by evaporative cooling.

In contrast to all known systems, the greatest reduced pressure and, with that, the greatest extraction performance in this system is at the place, where the fumes enter the fume-extraction duct; the reduction in pressure decreases uniformly over the respective numbers of jet ventilators up to the end of the fume-extraction duct. As a result, the system performance drops only insignificantly even if one or more of the jet ventilators fails. With that, this method and the device for the extraction of fumes and heat as well as for the operational ventilation in traffic structures and enclosed spaces differs basically from all those previously known.

The entry of fumes and plume gases in the region of the openings of the fume-extraction duct is supported by the hot air currents of the fire itself Since static pressures are inversely proportional to velocities, a reduced pressure acts permanently in the direction of the fume-extraction duct. This ensures that all stray fumes are picked up and that fumes cannot return to the traffic space, even if there are leaks in the duct.

In the openings of the fume-extraction duct 2*a*, there are either fixed air baffle plates 7 (lamellas), preferably set at an angle of 60° or 90° to the direction of flow or, in several places, controllable air baffle plates 7, with which the openings can also be closed off 2*b*. Because of the differences in the flow velocities of the gases in the traffic space (such as a tunnel) and in the fume-extraction duct (dynamic pressure components), flow of fumes from the fume-extraction duct back into the traffic space is prevented. If extraction is to take place or can take place only in one direction in the smoke-extraction duct, only the jet ventilators of one side need be switched on, in order to achieve the single-point extraction of the fumes.

For the operational ventilation according to the principle of the semi-transverse ventilation by the outgoing air, the jet ventilators (rpm-controlled) can be operated as in the case of a fire. The jet ventilators 3 to the right of the extraction opening 2*a* work to the right, those to the left work to the left. If the operational ventilation is to work according to the principle of the semi-transverse ventilation by incoming air, the jet ventilators 3 to the right of the extraction opening 2*a* work to the left and those to the left work to the right. For energetic reasons, however, it is sufficient for the operational ventilation to control only one direction, the incoming air or the outgoing air, with jet ventilators of FIGS. 2*a* and 2*b*. For the semi transverse ventilation by incoming air, all jet ventilators to the right of the ventilation point are switched on to the left and only one jet ventilator on the left side works to the right. By these means, it is insured that the fresh air 9 at the ventilation point enters the traffic space from the smoke-extraction duct 2. The outgoing air 10 flows through the traffic space and the fume-extraction duct. For the semi-transverse ventilation by the outgoing air of FIG. 2*b*, only the jet ventilators 3, which lie to the left opening-ventilation point 2*a* are switched on towards the left; this results in a single-point extraction of the outgoing air. The fresh air 9 is supplied over the traffic space and the fume-extraction duct 2 with appropriately set air baffle plates in the openings 2*a*. The combination of semi-transverse ventilation by outgoing air and semi-transverse ventilation by incoming air of FIG. 2*c* is also possible for an operational ventilation.

Above all, the advantages achieved with the invention lie therein that

- the system reacts rapidly in the event of a fire (high extraction performance in the single-point system independently of the position of the fire),
- leakages have no effect on the extraction performance because of the functioning principal,
- there is no damage (even if the installation works for a longer time) because the fumes are cooled directly and/or indirectly
- there can be no detonations,
- by appropriately controlling the jet ventilators, the device realizes a semi-transverse ventilation by outgoing air as well as a semi-transverse ventilation by incoming air and
- the system performance is decreased only insignificantly by the possible failure of some jet ventilators.

The method and device for extracting fumes and heat and for providing operational ventilation for traffic structures and enclosed spaces of claims 1 to 10 can advantageous can be combined with the already proposed Method For Purifying Outgoing Air By Removing Particles And Gases of DE 196 46 766.7.

The contents of the Figures are summarized once again in the following.

FIG. 1 diagrammatically represents the case of a fire in the tunnel with extractions of fumes and heat on both sides. In the region of the detected fire 5, the jet ventilators 3 remain switched off; evaporative cooling 6 is switched on here. To the right and left of the fire 5, up to the end of the fume-extraction duct, all jet ventilators 3 are switched on and the ceiling openings are closed off preferably over controllable air baffle plates 7. Consequently, a single point extraction results in the region of the fire 5.

Figure 2A:
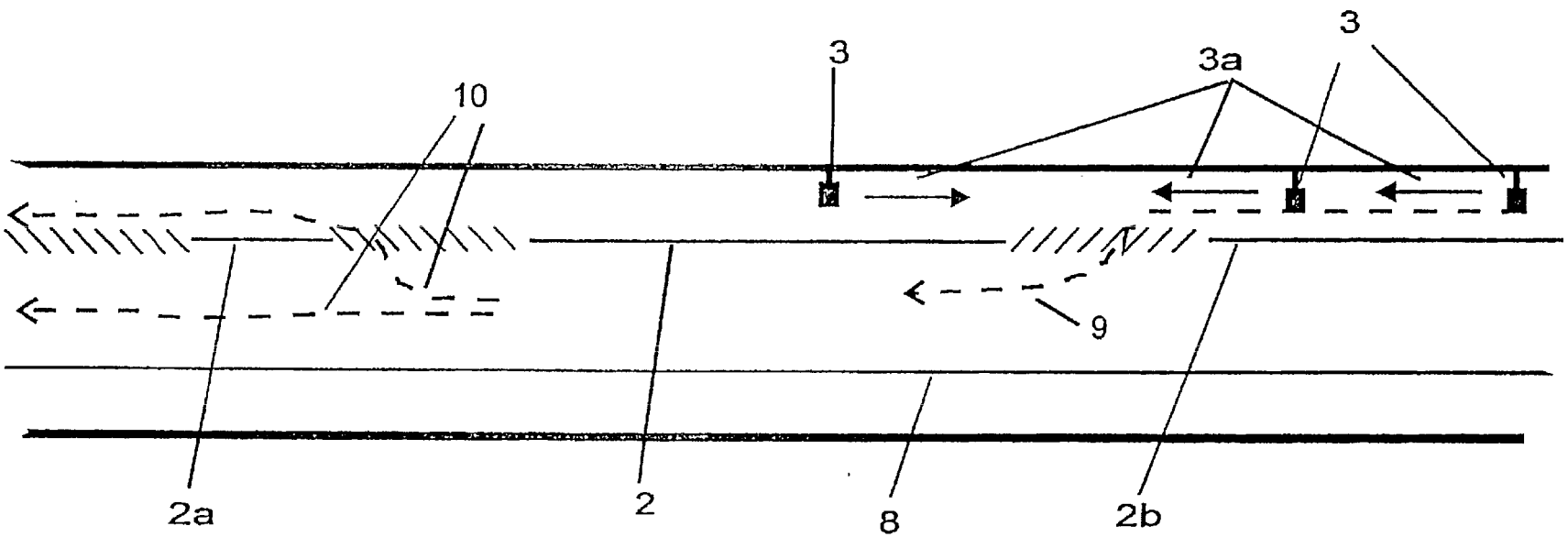
Figure 2B:
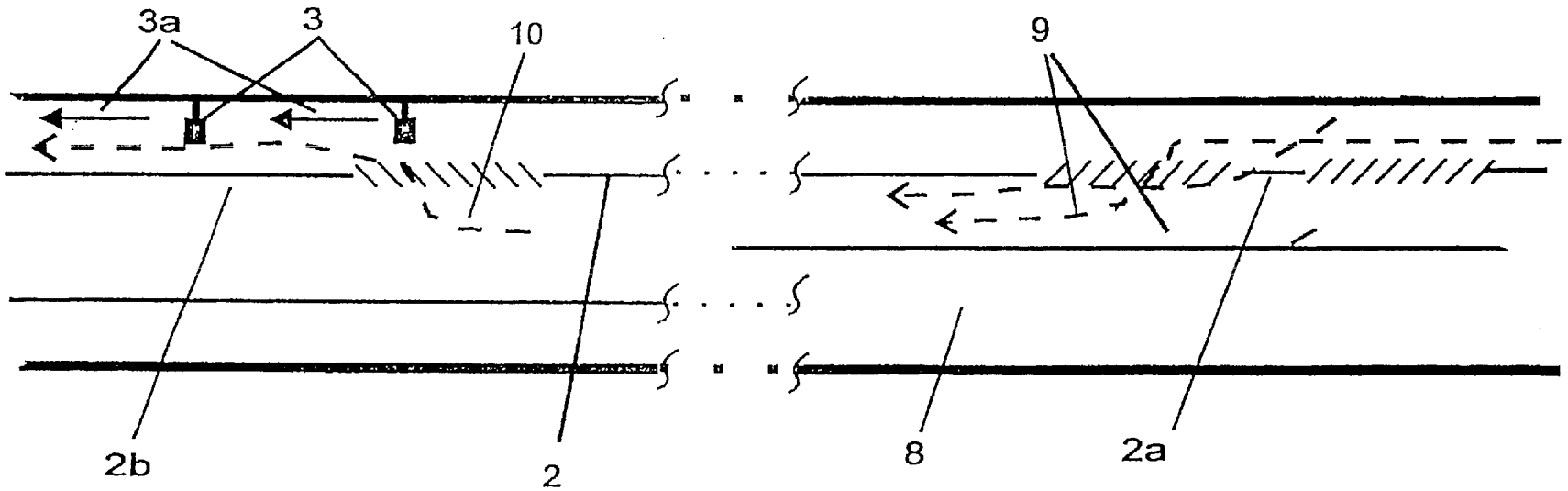
Figure 2C:
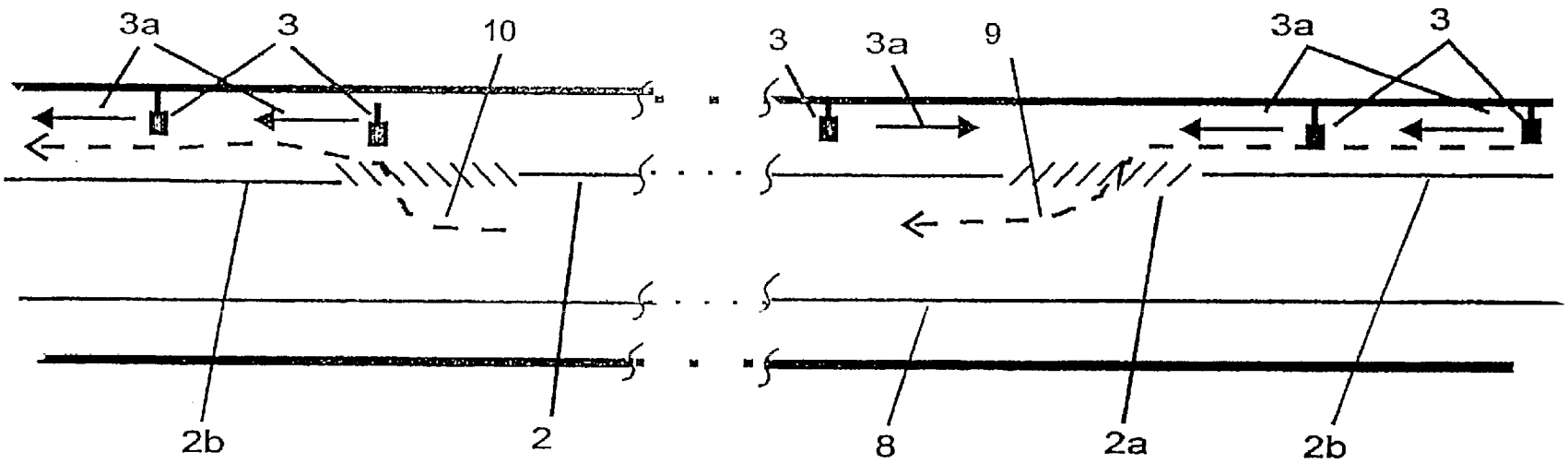

FIGS. 2*a*, 2*b* and 2*c* represent the operational state of ventilation with the functions of semi-transverse ventilation by incoming air and by outgoing air and the combination of these two types of ventilation.

What is claimed is:

1. A method for the extraction of gases and heat in the event of a fire as well as for operational ventilation in traffic structures and traffic enclosed spaces having a ceiling by means of a ceiling duct having openings which are adjustable to be open or closed off downward towards the traffic space and reversible jet ventilators in the duct of controllable rpm and capable of being pulsed, wherein, in the case of a fire, gases in a length of the ceiling duct commencing from a location of the fire and extending up to an end of the duct are accelerated uniformly over said length by pulsing of the jet ventilators in such a manner that the greatest reduced pressure or the highest extraction performance is produced at those of said openings which are in the vicinity of the fire, where the jet ventilators are not in operation, and a single-point extraction takes place, said extraction being so effected as to be two-sided or in one direction by so controlling the reversible jet ventilators as to attain either said two-sided extraction or said extraction in one direction and in the case of ventilation, operational ventilation with the functions of semi-transverse outgoing air ventilation, semi-transverse incoming air ventilation or a combination of semi-transverse incoming air ventilation and semi-transverse outgoing air ventilation is effected by so operating the reversible jet ventilators as to effect a selected one of said functions.

2. The method of claim 1, wherein the gases in the ceiling duct are accelerated in such a manner in the event of a fire that velocity of the gases in the ceiling duct is higher than that in the traffic space, whereby a permanent, dynamic reduced pressure is produced by the Bernoulli principle thereby to effect a flow of the gases in the direction of the ceiling duct.

3. The method of claim 1, further comprising cooling the duct and apparatus associated therewith by means of water in the event of fire.

4. The method of claim 1, wherein, in the event of fire, hot gases, after entering the openings, are cooled by evaporative cooling means, which are disposed in the interior of the ceiling duct and distributed over the whole length of the ceiling duct, and the final cooling temperature is controlled so that no condensate is formed.

5. Apparatus for the extraction of gases and heat in the event of fire as well as for operational ventilation in traffic structures and traffic enclosed spaces having a ceiling, comprising a ceiling duct having openings communicating with the interior of the traffic structure or traffic endorsed space, reversible jet ventilators in the duct of controllable rpm and capable of being pulsed, said jet ventilators being distributed over the entire length of the duct, wherein, in the case of a fire, gases in a length of the ceiling duct commencing from a location of the fire and extending up to an end of the duct are accelerated uniformly over said length by pulsing of the jet ventilators in such a manner that the greatest reduced pressure or the highest extraction performance is produced at those of said openings which are in the vicinity of the fire, where the jet ventilators are not in operation, and a single-point extraction takes place, said extraction being so effected as to be two-sided or in one direction by so controlling the reversible jet ventilators as to attain either said two-sided extraction or said extraction in one direction and in the case of ventilation, operational ventilation with the functions of semi-transverse outgoing air ventilation, semi-transverse incoming air ventilation or a combination of semi-transverse incoming air ventilation and semi-transverse outgoing air ventilation is effected by so operating the reversible jet ventilators as to effect a selected one of said functions.

6. Apparatus according to claim 5, further comprising water ejecting means disposed in the duct.

7. Apparatus according to claim 5, further comprising baffle plates in the openings.

8. Apparatus according to claim 5, further comprising louvers in the openings and means for controlling the louvers.

9. Apparatus according to claim 5 wherein the duct containing jet ventilators is comprised of a plurality of modules, each of said modules comprising a predetermined length of duct containing a predetermined number of jet ventilators.

* * * * *